US005465968A

United States Patent [19]

Aizawa et al.

[11] Patent Number: 5,465,968

[45] Date of Patent: Nov. 14, 1995

[54] GOLF CLUBHEAD HAVING BERYLLIUM FACE PLATE

[75] Inventors: Yuichi Aizawa; Yutaka Oku, both of Tokyo, Japan

[73] Assignee: Daiwa Golf Co., Ltd., Tokyo, Japan

[21] Appl. No.: 219,892

[22] Filed: Mar. 30, 1994

[30] Foreign Application Priority Data

Mar. 31, 1993 [JP] Japan ..... 5-015749 U

[51] Int. Cl.[6] ..... A63B 53/04

[52] U.S. Cl. ..... 273/167 H; 273/173; 273/167 J

[58] Field of Search ..... 273/77 R, 167 R, 273/78, 173, 175, 167 H, 167 J

[56] References Cited

U.S. PATENT DOCUMENTS

| | | | |
|---|---|---|---|
| 3,834,700 | 9/1974 | Averbach | 273/173 |
| 3,975,023 | 8/1976 | Inamori | 273/173 |
| 4,749,197 | 6/1988 | Orlowski | 273/167 H |
| 4,792,140 | 12/1988 | Yamaguchi et al. | 273/78 |
| 5,024,437 | 6/1991 | Anderson | 273/78 |
| 5,261,664 | 11/1993 | Anderson | 273/167 H |
| 5,288,070 | 2/1994 | Chen | 273/167 H |
| 5,310,185 | 5/1994 | Viollaz et al. | 273/78 |
| 5,346,216 | 9/1994 | Aizawa | 273/167 H |
| 5,362,055 | 11/1994 | Rennie | 273/167 J |

FOREIGN PATENT DOCUMENTS

| | | |
|---|---|---|
| 1-72269 | 5/1989 | Japan . |
| 3-97474 | 4/1991 | Japan . |

*Primary Examiner*—V. Millin
*Assistant Examiner*—William M. Pierce
*Attorney, Agent, or Firm*—Longacre & White

[57] ABSTRACT

A golf clubhead is constructed such that a cavity portion having a face plate supporting wall at its bottom is provided in a face portion of a metal head body so that a face plate made of beryllium is mounted on the cavity portion. It is possible to increase the flying or driving distance of a golf ball.

13 Claims, 2 Drawing Sheets

GOLF CLUBHEAD HAVING BERYLLIUM FACE PLATE

BACKGROUND OF THE INVENTION

The present invention relates to a golf clubhead improved to provide the longer flight distance of a hit golf ball.

Recently, beryllium which is small in specific gravity and high in modulus of elasticity, compared with stainless steel or a titanium alloy, has been used as a golf club material. For example, Japanese Utility Model Unexamined Publication No. Hei-1-72269 discloses a golf clubhead having a face portion defining a ball hitting surface of a head body, which portion is made by a beryllium copper material.

This golf clubhead, as shown in FIG. 5, includes a hollow metal head body 1 and a face portion 1*a* in the form of a thin face plate 3 made of a beryllium copper material attached to the hollow metal head body 1.

The aforementioned golf clubhead, however, has a structure in which the head body 1 is apt to be deformed at the time of hitting a golf ball since the head body 1 is constituted by a thin shell. Further, the face plate 3 is supported only by a marginal portion of the face portion 1*a*.

Therefore, in spite of using the beryllium material in the face plate 3, there arises the disadvantage that the characteristic high modulus of elasticity of beryllium causes deformation of the head body 1 at the time of the hitting of a ball, and thus the expected flight distance cannot be achieved.

Further, if the face plate 3 is made of pure beryllium in order to fully exhibit the advantage of the characteristic high modulus of elasticity, the face plate 3 is easily cracked or shattered since no consideration is given with respect to reducing the impact associated with the structure disclosed by the publication. The results of an experiment conducted by the present inventor shows that when a golf ball was hit with the golf clubhead having the disclosed structure, to which the pure beryllium face plate 3 of 3 mm thickness was attached, by an ordinary skilled gofer (the hitting impact is about 9800 Newtons), the pure beryllium face plate was shattered.

SUMMARY OF THE INVENTION

The present invention elaborates upon the aforementioned actual circumstances and an object therefore is to provide a golf clubhead in which the characteristic high modulus of elasticity of beryllium is used so that a golf ball is driven to reach a further distanced point.

To achieve the foregoing object, according to the present invention, a cavity portion having a face plate supporting wall at its bottom is provided in a face portion of a metal head body and a face plate made of beryllium is mounted in the cavity portion.

According to the present invention, hitting stress is transmitted to a golf ball without diminishing the striking force of beryllium because the face plate supporting wall supports the whole of the face plate to thereby heighten the striking force and prevent the deformation of the head body caused by impact at the time of hitting a ball. Due to the structure of the present invention, the face plate made of pure or almost pure beryllium can be employed as a material in a golf club head.

If the metal head body is made by an aluminum alloy which also has a relatively small specific gravity compared with stainless steel or a titanium alloy, the metal head body can be increased in size so that more weight is distributed of the peripheral portion of the face plate. Thereby, the inertia moment of the golf club head can be increased to decrease the shift of the golf club head during swinging to stably drive a golf ball to a desired point. This can also be achieved by using head body material having specific gravity at least twice as much as that of the face plate material.

The face plate material used in the present invention is preferably pure beryllium, but may be of an alloy of the beryllium and other components as long as that beryllium alloy has a specific gravity equal to or smaller than 2 and modulus of elasticity equal to or more than $294\times10^9$ N/m$^2$. Further, the thickness of the beryllium face plate of the present invention preferably falls within a range of 2 mm to 6 mm. The prior art structure disclosed by publication '269 would require the pure beryllium face plate to be at least 6 mm thick in order to prevent the crack or breakage of the face plate due to the impact of the golf ball in practical use. However, increasing the thickness of the beryllium face plate results in an excessive cost increase in manufacturing the golf clubhead since beryllium is an expensive material. On the other hand, the particular advantages of beryllium can be obtained by incorporating a pure beryllium face plate having at least 2 mm thickness if the beryllium face plate can be prevented from being cracked or shattered. Thus, in the present invention, a beryllium face plate of 2 mm to 6 mm is used with a face plate supporting wall provided behind the face plate so as to prevent flexing of the face plate during impact. This structure of the present invention can make it possible to efficiently obtain the significant characteristic advantage of beryllium as well as surely preventing the breakage of the face plate.

DETAILED DESCRIPTION OF THE PREFERRED EMBODIMENTS

Embodiments of the present invention will be described below in detail with reference to the drawings.

Figure 1:
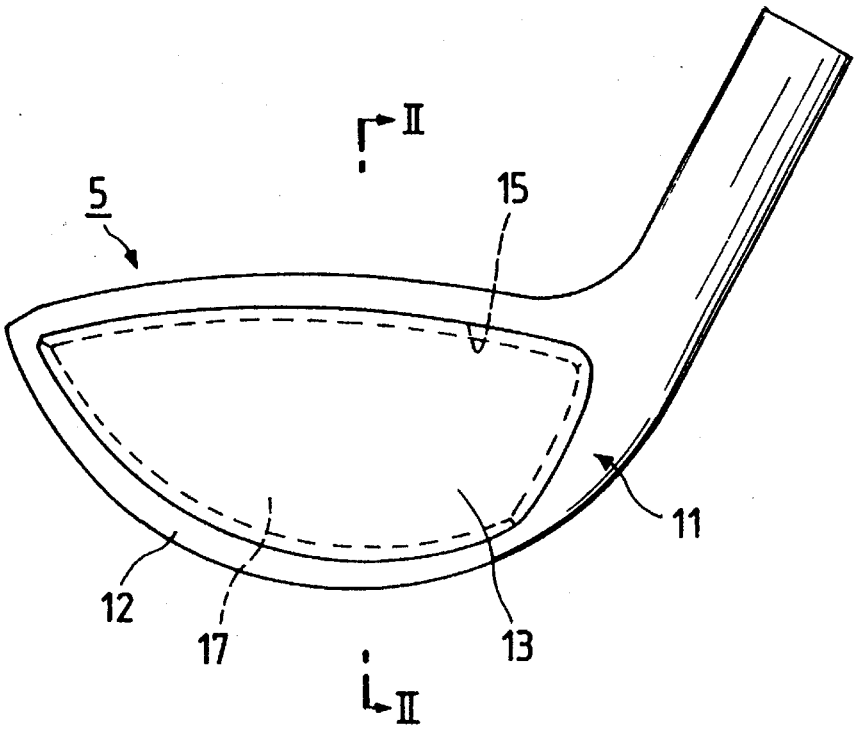
FIG. 1 is a front view of a golf clubhead according to a first embodiment of the present invention.
Figure 2:
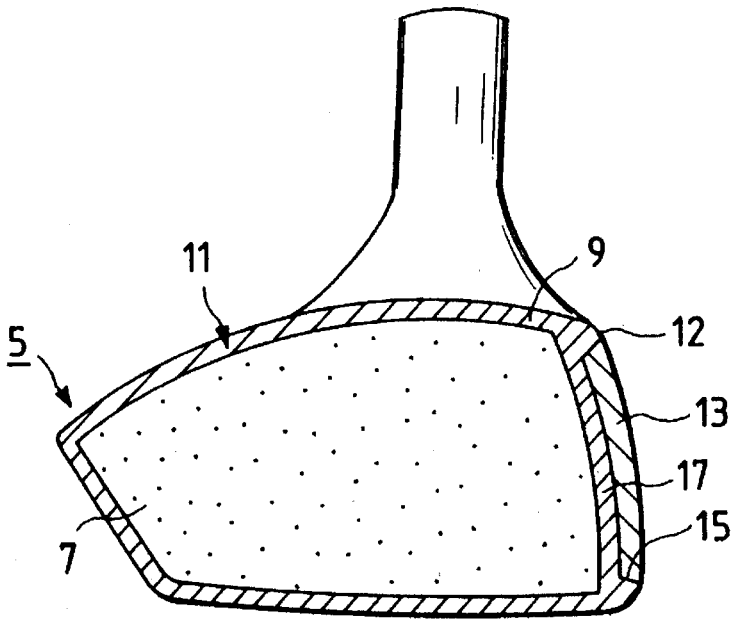
FIG. 2 is a sectional view taken along the line II—II in FIG. 1.

FIGS. 1 and 2 show a first embodiment of the present invention. In the drawings, the reference numeral 5 designates a golf clubhead used in a golf club called a "wood". The golf clubhead 5 is constituted by: a head body 11 obtained by covering a filler 7 made of a foam synthetic resin or the like with a metal shell 9 made of stainless steel, a titanium alloy, soft iron, a fiber-reinforced metal or the like; and a face plate 13 mounted onto a face portion 12 of the head body 11. The face plate 13 defines a curved ball hitting surface as shown in FIG. 2.

In the face portion 12 of the aforementioned head body 11, a cavity portion 15 having a shape substantially identical with the shape of the face portion 12 is formed so that a marginal projection from the face portion 12 extends outward from the bottom of cavity portion 15. At the bottom of the cavity portion 15, there is provided a face plate supporting wall 17 supporting the whole surface of the face plate 13 as shown in FIG. 2. Preferably, the supporting wall 17 has a thickness not less than 2 mm if the supporting wall 17 is made of stainless steel. Alternatively, the supporting wall 17 may be made of such a material with a suitable thickness that the amount of strain per unit load is equal to or smaller than that of 2 mm thick stainless steel. The face plate 13 is fitted and secured into the cavity portion 15. The face plate supporting wall 17 may be curved as shown in FIG. 2.

The face plate 13 is made of beryllium. The external shape of the face plate 13 is formed so as to be identical with the shape of the cavity portion 15. The face plate 13 has a thickness so as to be flush with the projection from the face portion 12 of the head body 11 when the face plate 13 is fitted and secured into the cavity portion 15.

As is well-known, beryllium is a metal which is smaller in specific gravity and higher in modulus of elasticity than stainless steel or a titanium alloy. The specific gravity of stainless steel and the specific gravity of a titanium alloy are 7.8 and 4.43 respectively, whereas the specific gravity of pure beryllium is 1.85. The modulus of elasticity of stainless steel and the modulus of elasticity of a titanium alloy are $206\times10^9$ N/m$^2$ and $113\times10^9$ N/m$^2$, whereas pure beryllium has a modulus of elasticity of $381\times10^9$ N/m$^2$.

Because the golf clubhead 5 according to this embodiment is configured as described above, when a golf ball is hit by the golf clubhead 5, the face plate supporting wall 17 supports the whole of the face plate 13 to thereby heighten the impulse force. Further, the face plate supporting wall 17 prevents the deformation of the head body 11 due to shock or impact at the time of hitting the ball, so that hitting stress is transmitted to the ball without diminishing the impulse force of beryllium due to its high modulus of elasticity.

Figure 5:
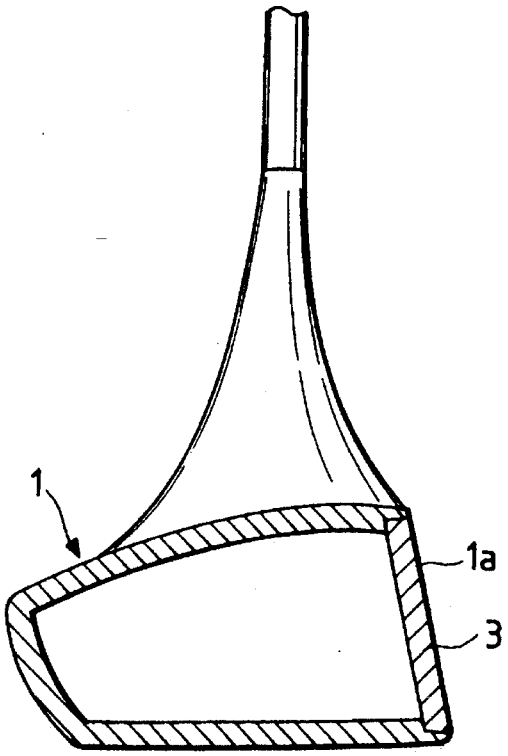
FIG. 5 is a sectional view of a conventional golf clubhead.

According to the present invention, therefore, the high modulus of elasticity characteristic of beryllium can be used efficiently, so that the flight distance of a ball is improved compared with the golf clubhead shown in FIG. 5.

Figure 3:
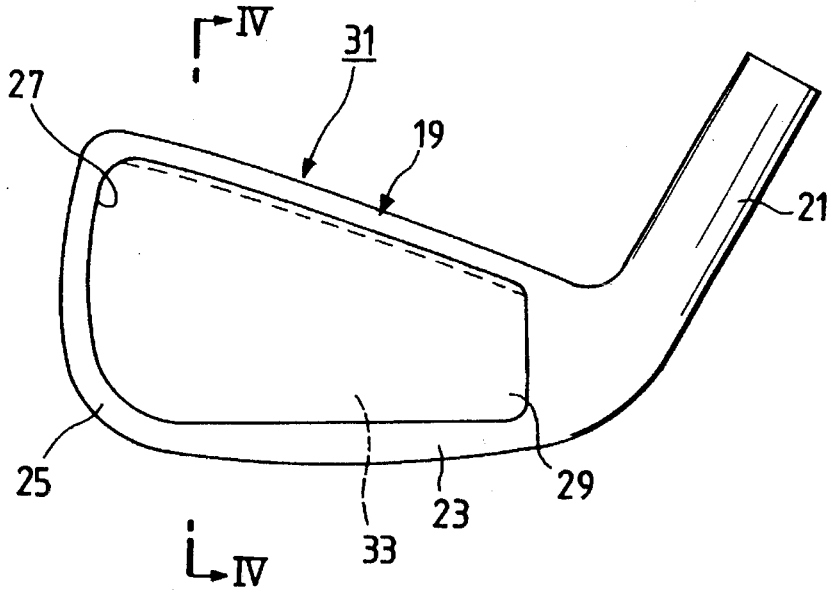
FIG. 3 is a front view of a golf clubhead according to a second embodiment of the present invention.
Figure 4:
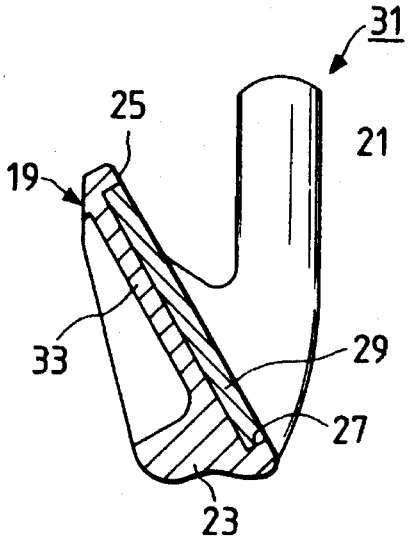
FIG. 4 is a sectional view taken along the line IV—IV in FIG. 3.

FIGS. 3 and 4 show a second embodiment of the present invention in which the present invention is applied to an "iron" clubhead.

In the drawings, the reference numeral 19 designates a head body formed of soft iron, stainless steel or the like. In the head body 19, a hosel portion 21, a sole portion 23, a face portion 25, and so on, are integrally formed in the same manner as a conventional golf clubhead. In the face portion 25, a cavity portion 27 defining a forward projection therearound is shaped so as to be substantially congruent to the face portion 25, and a face plate 29 is fitted and secured into the cavity portion 27. Thus, a golf clubhead 31 according to this embodiment is formed.

The sole portion 23 and the face portion 25 of the head body 19 and a face plate supporting wall 33 for connecting the heel side of the head body 19 and the toe side thereof to each other are formed at the bottom of the cavity portion 27 integrally with the head body 19. The face plate supporting wall 33 supports the face plate 29 to thereby heighten the impulse force and prevents the deformation of the head body 19 due to shock or impact at the time of hitting a ball in the same manner as in the first embodiment.

Also, in this embodiment, the face plate 29 is formed of beryllium. The external shape of the face plate 29 is formed so as to be identical with the shape of the cavity portion 27. The face plate 29 has a thickness so as to be flush with the forward projection from the face portion 25 of the head body 19 when the face plate 29 is fitted and secured into the cavity portion 27.

Because the golf clubhead 31 according to this embodiment is configured as described above, when a ball is struck by a golf club having the golf clubhead 31 attached thereto, the face plate supporting wall 33 supports the whole of the face plate 29 to thereby heighten the impulse force. Further, the face plate supporting wall 33 prevents the deformation of the head body 19 due to shock at the time of the hitting of the ball, so that hitting stress is transmitted to the ball without diminishing the impulse force due to beryllium having a high modulus of elasticity.

Accordingly, there arises an advantage that the characteristic high modulus of elasticity of beryllium can be used efficiently so that a flight distance of a ball is improved compared with a conventional iron clubhead.

As described above, according to the present invention, a cavity portion having a face plate supporting wall at its bottom is provided in a face portion of a metal head body so that a face plate made of beryllium is mounted in the cavity portion. Accordingly, the face plate supporting wall supports the whole of the face plate to thereby heighten the impulse force and prevents the deformation of the head body due to shock at the time of the hitting a ball. As a result, hitting stress is transmitted to the ball without diminishing the impulse force due to beryllium having a high modulus of elasticity.

According to the present invention, consequently, there arises an effect that the characteristic high modulus of elasticity of beryllium can be used efficiently so that the flight distance of a ball is improved compared with a conventional golf clubhead.

What is claimed is:

1. A golf clubhead comprising:

a metal head body having an open face portion;

a cavity portion in said face portion, said cavity portion having a face plate supporting wall at a bottom of said cavity portion, said face plate support wall closes said face portion; and a face plate composed of substantially pure beryllium with a specific gravity no greater than 2 and a modulus of elasticity at least $294\times10^9$ N/m$^2$ is mounted in said cavity portion.

2. The golf clubhead according to claim 1, wherein said face plate supporting wall supports said face plate across an entire interface between said face plate and said face plate support wall.

3. The golf clubhead according to claim 1, wherein said face plate defines a curved ball hitting surface.

4. The golf clubhead according to claim 1, wherein said face plate supporting wall is smaller in thickness than said face plate.

5. The golf clubhead according to claim 1, wherein said metal head body is made by an aluminum alloy.

6. The golf clubhead according to claim 1, wherein said metal head body is made by material having specific gravity at least twice as large as that of the face plate.

7. The golf clubhead according to claim 1, wherein said face plate has a thickness no greater than 6 mm.

8. The golf clubhead according to claim 7, wherein the thickness of said face plate is at least 2 mm.

9. The golf clubhead according to claim 8, wherein said face plate supporting wall is made of material having a strain amount per unit load no greater than an equivalent of 2 mm thick stainless steel.

10. The golf clubhead according to claim 9, wherein said face plate supporting wall is made of 2 mm thick stainless steel.

11. The golf clubhead according to claim 7, wherein said face plate supporting wall is made of material having a strain amount per unit load no greater than an equivalent of 2 mm thick stainless steel.

12. The golf clubhead according to claim 11, wherein said face plate supporting wall is made of 2 mm thick stainless steel.

13. A golf clubhead comprising:

a head body having a configuration substantially resistant to deformation;

a face plate supporting wall secured to a perimeter of said head body, said face plate supporting wall is congruent with and occludes said perimeter, a projection extending oppositely from said face plate supporting wall with respect to said head body, said projection coincides in shape with said perimeter;

a cavity portion defined by said projection and said face plate supporting wall, said cavity portion includes a mouth circumscribed by said projection and opening oppositely from said face plate supporting wall, said mouth is at least as large as an interior junction of said projection and said face plate supporting wall; and, a face plate composed substantially of beryllium, said face plate is congruent with and mounted in said cavity portion.

* * * * *